US005465659A

United States Patent [19]

Minen

[11] Patent Number: 5,465,659

[45] Date of Patent: Nov. 14, 1995

[54] AUTOMATIC MACHINE FOR BINDING BUNDLES OF PIPES OR THE LIKE

[75] Inventor: Ettore Minen, Manzano, Italy

[73] Assignee: Engen Meccanica Di Minen Ettore, Manzano, Italy

[21] Appl. No.: 206,942

[22] Filed: Mar. 7, 1994

[30] Foreign Application Priority Data

Mar. 17, 1993 [IT] Italy ..... UD93A043

[51] Int. Cl.[6] ..... B65B 13/34; B65B 13/14

[52] U.S. Cl. ..... 100/30; 100/26

[58] Field of Search ..... 100/26, 32, 30, 100/33 R

[56] References Cited

U.S. PATENT DOCUMENTS

| | | | |
|---|---|---|---|
| 3,220,338 | 11/1965 | Norbutas et al. | 100/30 |
| 3,439,606 | 4/1969 | Bursik et al. | 100/33 R |
| 3,557,684 | 1/1971 | Glasson | 100/26 |
| 3,767,885 | 10/1973 | Fryer | 100/26 |

FOREIGN PATENT DOCUMENTS

| | | | |
|---|---|---|---|
| 1059784 | 5/1954 | France | 100/30 |

*Primary Examiner*—Stephen F. Gerrity
*Attorney, Agent, or Firm*—Browdy and Neimark

[57] ABSTRACT

The automatic machine comprises: a guide ring to wind a tape about pipes or the like; a mobile sealing group to tension and bind a length of tape, a shoe to fold an end of the tape back on itself and a shearing group to cut the tape. The guide ring surrounds the bundle of pipes and exhibits a channel cut into its surface facing the guide ring center, which channel is of a section adapted to receive the tape from a bi-directional entrainer and through an aperture made in the guide ring. A second aperture in the guide ring receives an open clasp. The shoe can move from a position external of the ring to a position internal of the ring, in which latter position the shoe folds the end of the tape back such that it is held fast while the tape, after being wound about the pipe bundle, is tensioned prior to sealing.

5 Claims, 4 Drawing Sheets

AUTOMATIC MACHINE FOR BINDING BUNDLES OF PIPES OR THE LIKE

BACKGROUND OF THE INVENTION

The invention relates to an automatic machine for binding bundles of pipes or the like, which is especially useful, for example, downstream of pipe or bar measuring and cutting machines, or indeed any machine for cutting long narrow objects.

At present, a metal tape is wound around the objects to be bound and manually tightened by a binding machine: a metal tape seal is obtained by folding back the ends of the metal tape so that in section they exhibit an isosceles-like triangular shape.

The operations carried out by an operator when binding a bundle of pipes or the like objects is as follows:

first, the tape is wound once around the bundle;

next, a metal tape clasp is inserted and positioned with one end of the metal tape superposed on the other;

then, the free end of tape is partially folded back on itself so that it cannot accidentally free itself from the metal tape clasp;

the binding machine is used to tighten the metal tape;

the tape is separated from a tape supply source.

The principal drawback of the above-described method is that manual intervention is necessary to insert the free end of the tape in the tape clasp and, subsequently, to fold it back on itself.

The principal aim of the present invention is to obviate this drawback in the prior art by providing an automatic machine for binding pipe bundles or the like, rendering the binding operation simple and economical, and totally automatic.

A further aim of the invention is to realize an automatic machine of a contained size, so that it can easily be blended into the workplace without causing space difficulties.

A still further aim of the invention is to provide a machine able to bind both circular-section and square-section pipes or the like.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

DESCRIPTION OF THE PREFERRED EMBODIMENTS

Figure 1:
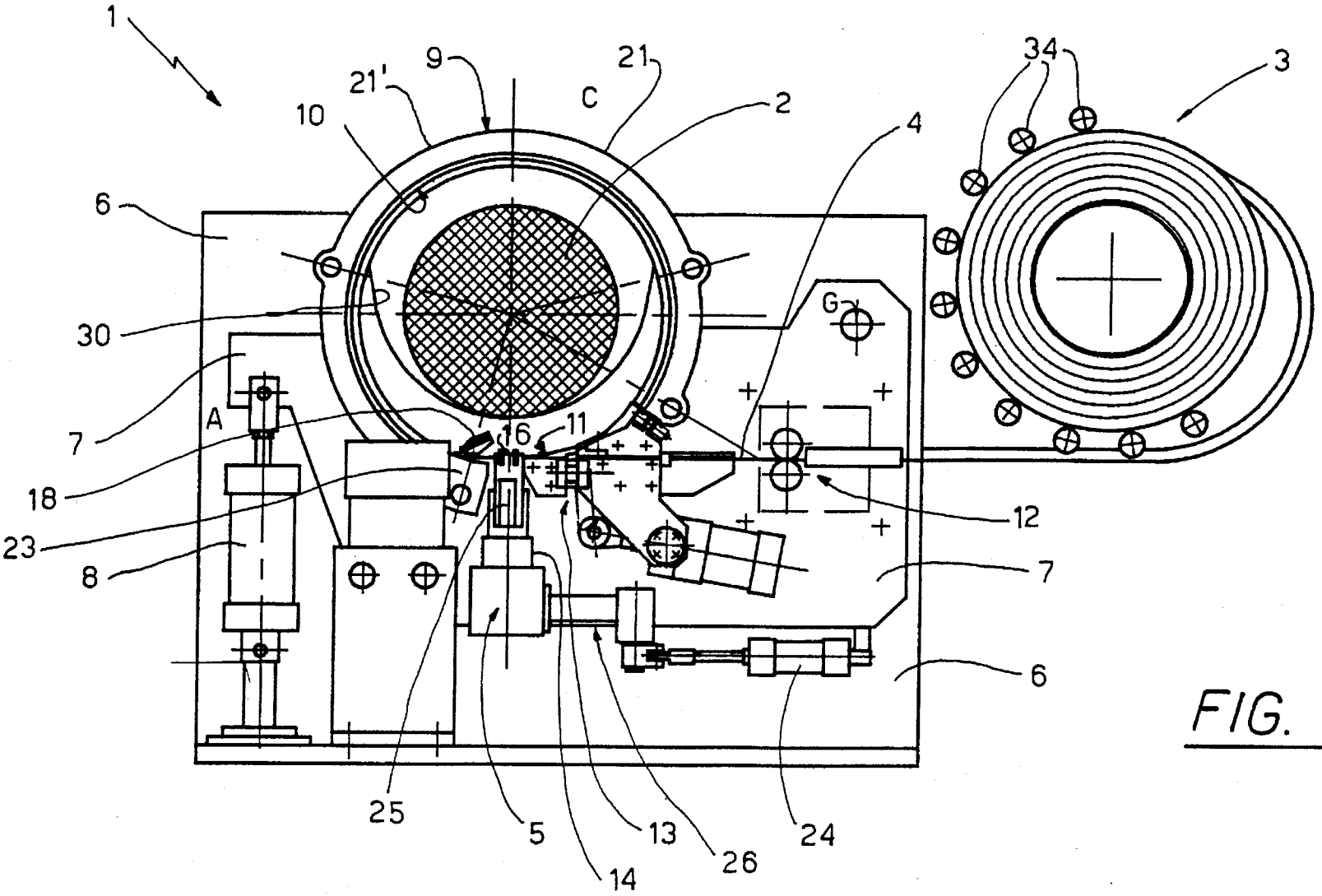
FIG. 1 is a frontal view of the machine of the invention, with the support plate in a lowered position, and some parts removed better to show others.

With reference to the figures, 1 denotes an automatic machine for binding bundles of pipes and the like.

The machine 1 essentially comprises at least one support 30 for the pipes 2, a magazine 3 for a tape 4, means for winding the tape 4 around the pipes 2 and a binder 5.

Figure 2:
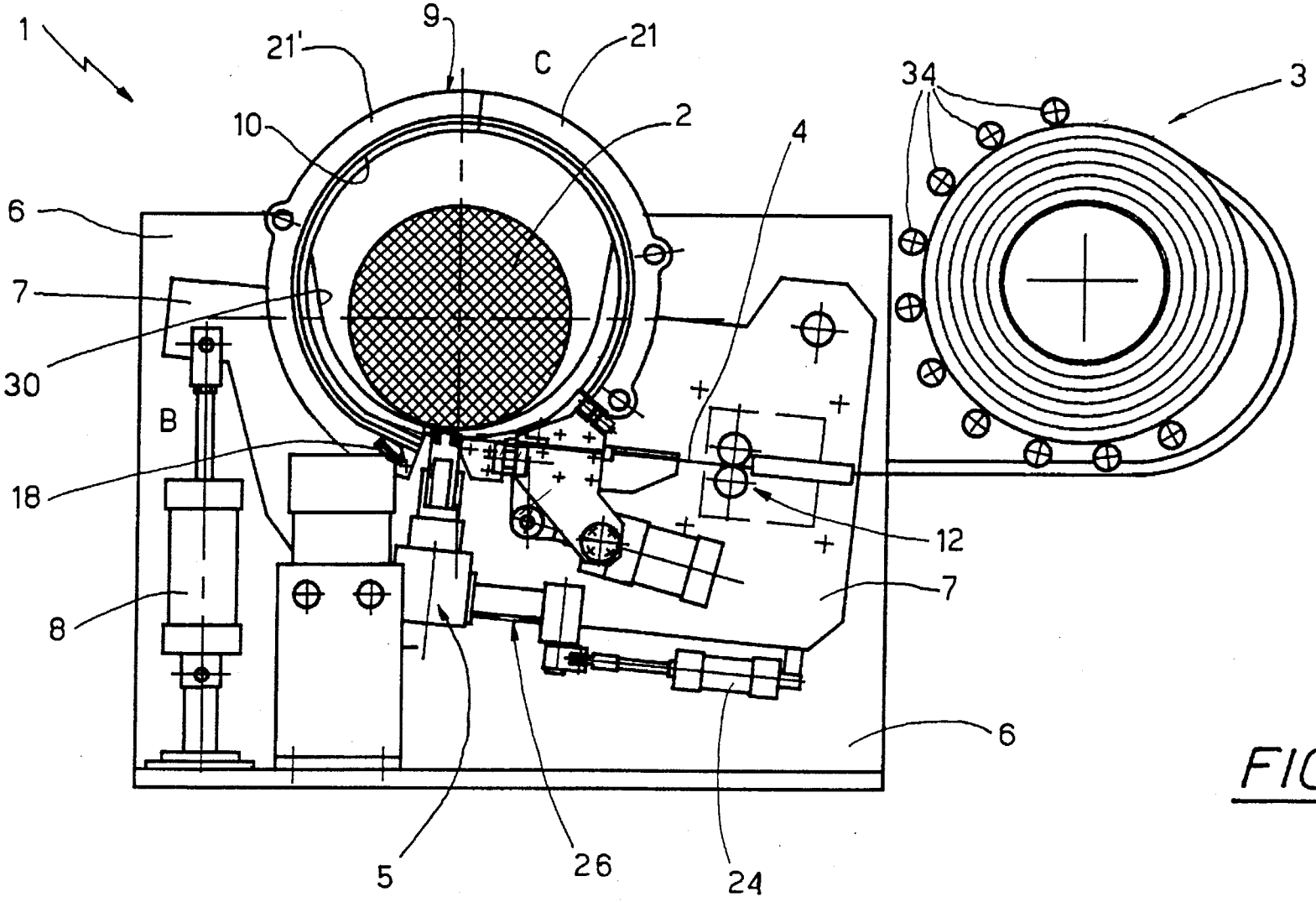
FIG. 2 is a frontal view of the machine, with the support plate in a raised position, and with some parts removed better to show others.
Figure 3:
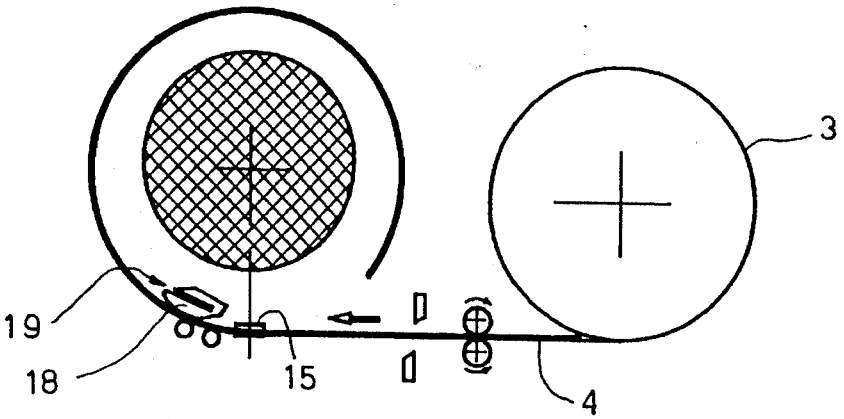
FIGS. 3 to 10 schematically show the sequence of binding operations.
Figure 4:
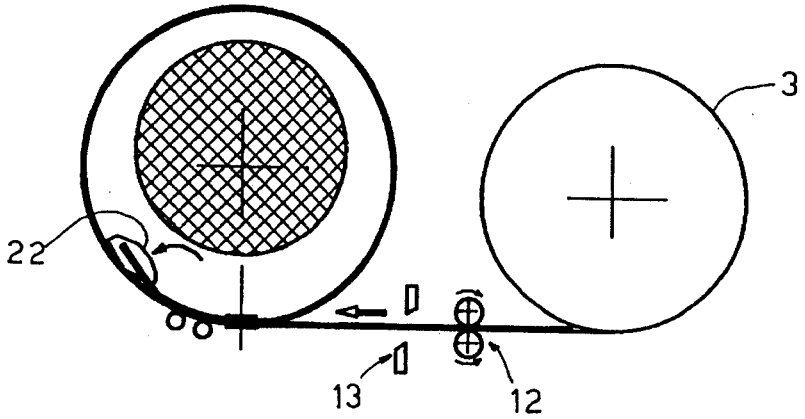
Figure 5:
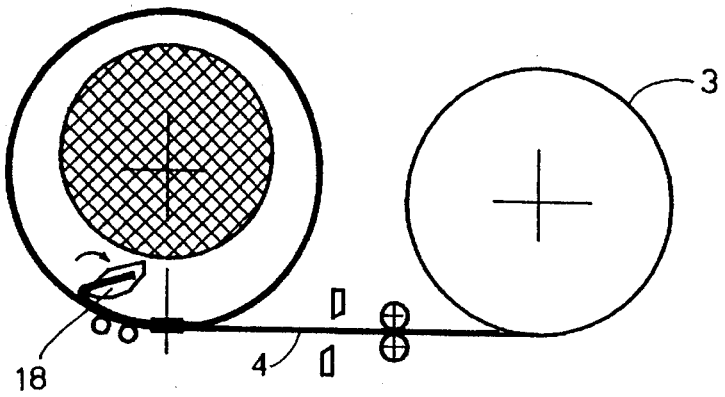
Figure 6:
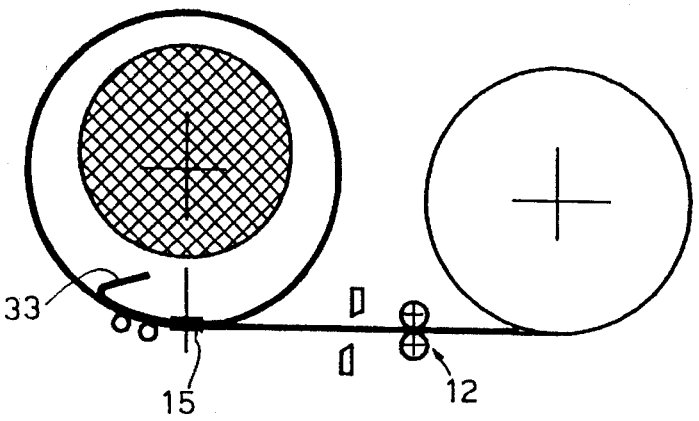
Figure 7:
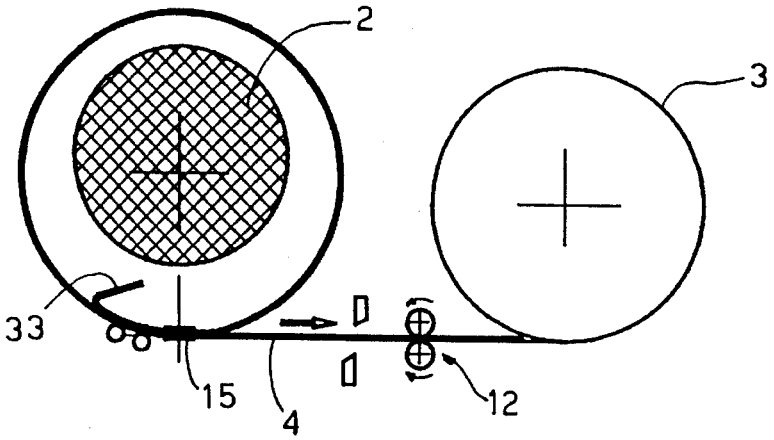
Figure 8:
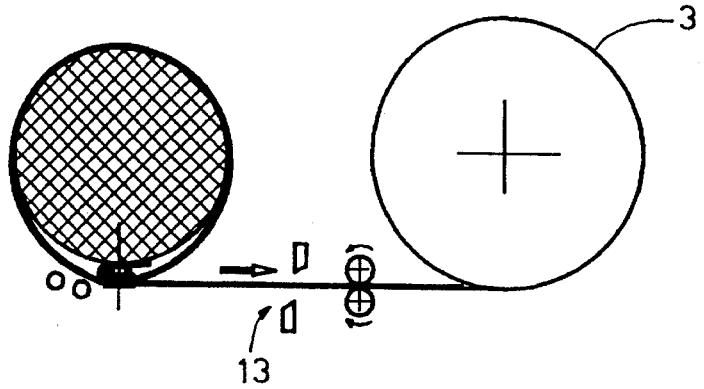
Figure 9:
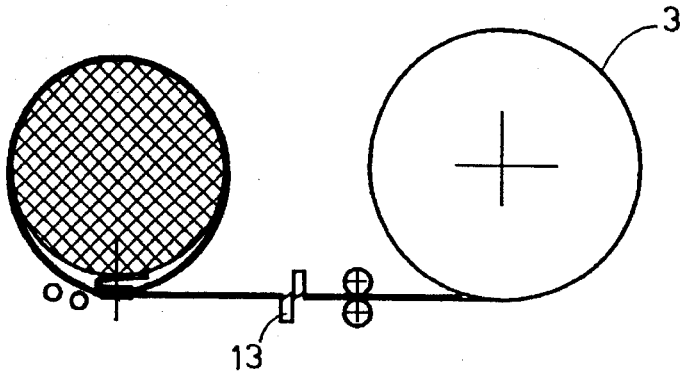

The support 30 is in the shape of a cradle and houses groups of pipes 2 such that they are suspended when they cross through the machine 1. In the configuration described herein (see FIGS. 1 and 2), one of the supports 30, which supports 30 will be hereinafter referred to as cradles 30, is in fact an integral part of a fixed frame 6 of the machine 1.

The magazine 3 is a completely closed structure, containing and guiding a roll of tape 4, and feeding the tape to a bi-directional entrainer 12. The roll rests on an idle roller group 34 arranged in an arc around the roll and spread out over an angle of just above 180 degrees. The idle roller group 34 facilitates the unwinding and rewinding of the tape 4, and the roll can be wound and unwound safely as needed, as it cannot exit unexpectedly from its seating. The external casing of the tape 4 roll is not shown in FIGS. 1 and 2 in order better to evidence the idle roller group 34, which is internal to said casing: the tract of casing guiding the tape 4, however, is illustrated, up to where it meets the inlet of the entrainer 12.

The winding mechanism of the tape 4 and the binder 5 is composed of:

a vertical support plate 7 pivoted at G to the fixed frame 6;

a pneumatic jack 8, for rotating the support plate 7 with respect to the fixed frame 6, between two extreme positions, ie. a completely disengaged position A (FIG. 1), where the support plate 7 is in a lowered position, and an engaged position B, (FIG. 2) where the support plate 7 is in a raised position;

a guide ring 9, solidly rotating with the support plate 7, which ring 9 surrounds the pipes 2 and includes a channel 10 along its internal surface having a section identical to that of the tape 4;

an aperture 11 tangentially bored in the lower part of the guide ring 9 for the insertion of the tape 4 into the channel 10;

a mobile tape sealing group 14 for positioning an open tape clasp 15 taken from a feeder (not illustrated) in a second aperture 16 made in the guide ring 9 close to the first aperture 11 and along the channel 10, and for blocking the tape clasp 15 around the tape 4;

a shoe 18, mobile between two positions, a first disengaged position wherein the shoe 18 is external of the guide ring 9 and a second position in which the shoe 18 is internal of the guide ring 9, designed to fold the free end of the tape 4 partially on itself so that the folded end 33 cannot back out of the open tape clasp 15;

a bi-directional entrainer 12 for inserting the tape 4 in the channel 10 by pushing it through the aperture 11, and also for recalling it when the tape 4 is to be tensed prior to final tape sealing; and a shears group 13 to cut the tape 4.

Figure 10:
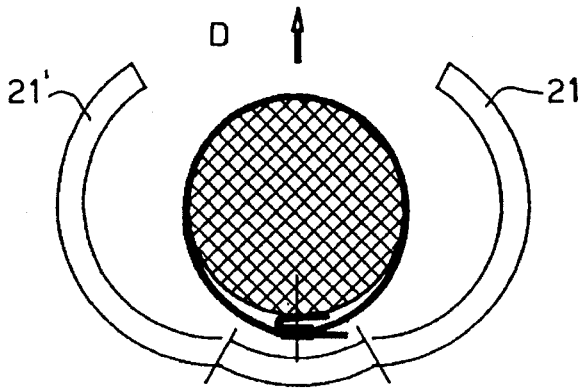

The guide ring 9 comprises two semi-rings 21, 21' which are mobile between two positions, one closed C in which they form a ring (FIG. 1), and one open D (FIG. 10) to facilitate the positioning of the pipes 2 in the guide ring 9, which operation is performed from above. The tangential aperture 11 is positioned in the lower part of the guide ring 9, at the hinges of the two semi-rings 21, 21', where there is also the second aperture 16. The two apertures 11 and 16 can also be arranged together, forming a single larger aperture.

The mobile tape sealing group 14 is constituted by pliers 25 of known type, mounted on a mobile support 26 activated by a pneumatic jack 24. The support 26 moves the pliers 25 between a first loading position in which the pliers 25 lift an open tape clasp 15 from the feeder (not illustrated) and a second position wherein the pliers 25 position the open tape clasp 15 in the second aperture 16. When the tape clasp 15 is placed in the second aperture 16, it completes the ring 9, which was previously broken by said aperture 16, and thus the tape 4 is sure to pass through the aperture 16 when it is inserted in the channel 10.

The tape clasp 15 is thus totally contained and lodged within the aperture 16, such that it cannot move longitudinally along the channel 10; the tape clasp therefore being prevented from being dragged by the tape 4 during the tensioning phase of the tape 4.

The shoe 18, see figures from 3 to 5, is supported by a motorized lever assembly 23 which both rotates and translates it. The front end of the shoe 18 exhibits a spout-shaped opening 19 into which the free end of the tape 4 is inserted. The back of the shoe 18 further exhibits a smooth guide zone 22 which presses the tape 4 into the channel 10 during the insertion phase.

The machine 1 further exhibits a series of electrical command and control devices which are not described herein because they are of known type.

The functioning of the invention is as follows.

At the beginning of the work cycle, the guide ring 9 is in an open position D so that pipes 2 or the like can be loaded from above, while the support plate 7 is in a lowered position A. The pipes 2 are lowered from above between the cradles 30 so that the two semi-rings 21, 21' can be closed about them. Obviously, the pipes 2 could be loaded frontally without having to open the semi-rings 21, 21'.

Subsequently the mobile tape sealing group 14 is activated and collects an open tape clasp 15 from the feeder (not illustrated) and positions it in the second aperture 16. Then the bi-directional entrainer 12 inserts the tape 4 in the channel 10, through the tangential aperture 11.

The tape 4 first crosses the open tape clasp 15 and then inserts below the shoe 18, specially positioned in the guide ring 9 with the back 22 turned towards the channel 10, which obliges it to enter the channel 10. Once it has completed a full cycle, the tape 4 once more inserts in the open tape clasp 15 and finishes its run into the spout opening 19 of the shoe 18, rotated for this purpose. The following rotation of the shoe 18 partially folds the end of the tape 4 back on itself, trapping it from slipping out of the still-open tape clasp 15.

At this point the shoe 18 is brought into the disengaged position, externally of the guide ring 9, to enable the entrainer 12 to recall the tape 4 in order to tension it. At the same time, the support plate 7 is raised into position B, thus nearing the pipes 2 to the tape clasp 15. When the tape 4 stops moving because it has tensed sufficiently, the tape sealing group 14 is activated to close the tape clasp 14, and subsequently the shears group 13 is operated to cut the tape 4.

At the end of this first binding the tube bundle is repositioned and subjected to a subsequent identical binding to the one presently described. To obtain a considerable production increase, more than one machine can be installed to perform contemporaneously the number of bindings desired.

What is claimed:

1. An automatic machine for binding pipes, comprising:

a support for groups of pipes;

a roll of tape for winding around and binding the pipes;

a fixed-position frame of the machine;

a mobile support plate, mounted on the fixed frame;

a guide ring solidly connected to the mobile support plate, said ring including an internal surface scored by a channel, a circumferential first aperture, the tape passing through the first aperture in order to be inserted in the channel, and a second aperture;

a shoe movable between a first position at which said shoe receives an end of the tape and a second position in which the end of the tape is folded back; said shoe is also movable between an internal position in which it is internal of the ring and an external position in which it is external of the ring, at which external position the tape is disengaged from the shoe;

a mobile tape sealing group arranged in proximity to the second aperture, for positioning an open tape clasp therein and for compressing an open tape clasp on the tape and buckling it thereon once the tape has been wound around the pipes;

a bi-directional entrainer for inserting the tape through the first aperture and into the channel and for recalling the tape so that the tape is tensioned after the tape has been wound about the pipes; and a shears group to cut the tape after the tape has been tensioned;

wherein the guide ring comprises at least two semi-rings which are mobile between a closed configuration, in which they form a closed ring, and an open configuration.

2. An automatic machine for binding pipes, comprising:

a support for groups of pipes;

a roll of tape for winding around and binding the pipes;

a fixed-position frame of the machine;

a mobile support plate, mounted on the fixed frame;

a guide ring solidly connected to the mobile support plate, said ring including an internal surface scored by a channel, a circumferential first aperture, the tape passing through the first aperture in order to be inserted in the channel, and a second aperture;

a shoe movable between a first position at which said shoe receives an end of the tape and a second position in which the end of the tape is folded back; said shoe is also movable between an internal position in which it is internal of the ring and an external position in which it is external of the ring, at which external position the tape is disengaged from the shoe;

a mobile tape sealing group arranged in proximity to the second aperture, for positioning an open tape clasp therein and for compressing an open tape clasp on the tape and buckling it thereon once the tape has been wound around the pipes;

a bi-directional entrainer for inserting the tape through the first aperture and into the channel and for recalling the tape so that the tape is tensioned after the tape has been wound about the pipes; and a shears group to cut the tape after the tape has been tensioned;

wherein the shoe exhibits a spout-like aperture in which a free end of the tape is inserted.

3. The machine according to claim 2, wherein the shoe is rotatably supported by a motorized lever mechanism, whereby the shoe can rotate about the end of the spout-like aperture.

4. An automatic machine for binding pipes, comprising:

a support for groups of pipes;

a roll of tape for winding around and binding the pipes;

a fixed-position frame of the machine;

a mobile support plate, mounted on the fixed frame;

a guide ring solidly connected to the mobile support plate, said ring including an internal surface scored by a channel, a circumferential first aperture, the tape passing through the first aperture in order to be inserted in the channel, and a second aperture;

a shoe movable between a first position at which said shoe receives an end of the tape and a second position in which the end of the tape is folded back; said shoe is also movable between an internal position in which it is internal of the ring and an external position in which it is external of the ring, at which external position the tape is disengaged from the shoe;

a mobile tape sealing group arranged in proximity to the second aperture, for positioning an open tape clasp therein and for compressing an open tape clasp on the tape and buckling it thereon once the tape has been wound around the pipes;

a bi-directional entrainer for inserting the tape through the first aperture and into the channel and for recalling the tape so that the tape is tensioned after the tape has been wound about the pipes;

a shears group to cut the tape after the tape has been tensioned; and a magazine comprising a closed box structure for at least partially containing the roll of tape, the magazine including shaped means to guide the tape until the tape meets the bi-directional entrainer.

5. The machine according to claim 4, wherein the magazine includes a plurality of idle rollers which support the roll of tape;

said plurality of idle rollers being arranged along an arc corresponding to a circumference of the roll of tape and being spaced such that a total angle of spread of the rollers is more than 180 degrees.

* * * * *